US010598362B2

(12) United States Patent
Xue et al.

(10) Patent No.: US 10,598,362 B2
(45) Date of Patent: Mar. 24, 2020

(54) LED LAMP WITH BUILT-IN POWER SUPPLY

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Yuanfang Xue, Zhejiang (CN); Zhaoyong Zheng, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/422,456

(22) Filed: May 24, 2019

(65) Prior Publication Data

US 2019/0360675 A1 Nov. 28, 2019

(30) Foreign Application Priority Data

May 24, 2018 (CN) ..... 2018 1 10507107

(51) Int. Cl.

| | |
|---|---|
| ***F21S 8/00*** | (2006.01) |
| ***F21S 9/00*** | (2006.01) |
| ***F21V 23/00*** | (2015.01) |
| ***F21V 19/00*** | (2006.01) |
| ***F21V 23/02*** | (2006.01) |
| ***F21V 29/10*** | (2015.01) |
| ***F21K 9/20*** | (2016.01) |

(52) U.S. Cl.

CPC ..... *F21V 23/023* (2013.01); *F21K 9/20* (2016.08); *F21V 29/10* (2015.01)

(58) Field of Classification Search

CPC .... F21S 9/00; F21S 8/00; F21V 19/00; F21V 23/00; F21V 23/001; F21V 23/007; F21V 23/023; F21K 9/20; F21K 9/237

See application file for complete search history.

(56) References Cited

U.S. PATENT DOCUMENTS

2012/0319620 A1* 12/2012 Vigilante ..... H05B 33/0809 315/297
2014/0313774 A1* 10/2014 Myers ..... F21V 31/005 362/612
2014/0321108 A1* 10/2014 Neal ..... F21V 31/005 362/217.02
2016/0102825 A1* 4/2016 Scribante ..... F21S 8/022 362/217.12

FOREIGN PATENT DOCUMENTS

CN 206545837 U * 10/2017
CN 208058587 U * 11/2018

* cited by examiner

*Primary Examiner* — Thai Pham
(74) *Attorney, Agent, or Firm* — Wang Law Firm, Inc.

(57) ABSTRACT

An LED lamp with built-in power supply includes housing provided with a driving power supply; and an LED lamp holder assembly fixedly connected to the outside of the housing and connected to the driving power supply by wires. The housing is provided with a wire slot, and wires connecting the driving power supply can be drawn out from the wire slot and housed in the wire slot, and then connected to the LED lamp holder assembly. The lamp structure sets the driving power supply and LED lamp panel in two separate cavities to avoid the LED lamp panel being in high temperature environment for a long time and extend its service life; the housing is provided with a wire slot, the wire slot can accommodate the wires connecting the driving power supply and the LED lamp panel.

8 Claims, 5 Drawing Sheets

LED LAMP WITH BUILT-IN POWER SUPPLY

RELATED APPLICATION

This application claims priority to Chinese Patent Application No. CN 201810507107.3, filed on May 24, 2018.

FIELD OF THE TECHNOLOGY

The present invention relates to lamps, with particular emphasis on a LED lamp with built-in power supply.

BACKGROUND OF THE INVENTION

As a sunrise industry, LED lamps have been widely used in various lighting scenes, especially the recent development of LED technology, which has greatly improved the luminous efficiency of LED lamps, and is therefore favored by the lighting market.

Nowadays, there are many kinds of LED lamps in the market, most of which are driven by built-in power supply, the LED lamps with built-in power supply can be directly connected to the original circuit and has wide applicability. Therefore, the LED lamp with built-in power supply becomes a new type of lamps that replaces fluorescent lamps.

However, LED lamps with built-in power supplies on the market currently have the following disadvantages:

1. The built-in power supply and lamp panel of the LED lamp are arranged in the inner cavity of the same housing. On the one hand, the inner cavity of the housing is relatively narrow, and it is difficult to assemble the power supply component and the lamp panel at the same time; On the other hand, the built-in power supply will generate more heat, and a large amount of heat is usually difficult to send out quickly in the inner cavity of the housing, which seriously affects the luminous performance of the lamp panel and shortens the service life of the lamp panel.

2. The built-in power supply and the light board of the LED lamp are usually connected by wires. During installation, it is difficult to avoid the occurrence of pressure lines, broken wires, wiring difficulties, etc.

Existing LED lamps with built-in power supplies need further improvement.

BRIEF SUMMARY OF THE INVENTION

The technical problem to be solved by the present invention is to provide an LED lamp with built-in power supply, which is simple in structure, convenient for routing, and increases the service life of the LED lamp panel.

The technical scheme adopted by the invention to solve the above technical problems is as follows: an LED lamp with built-in power supply, comprising a housing, providing with a driving power supply built-in; an LED lamp holder assembly fixedly connected to an outer side of the housing and connected to the driving power supply via wire; and a wire slot is arranged on the housing, and the wire connected to the driving power supply can be taken out from the wire slot and received in the wire slot and then connected to the LED lamp holder assembly.

advantageously, the LED lamp holder assembly includes an LED lamp panel, a lamp holder and a lamp cover; the lamp holder and the lamp cover are fastened to form a holding room, and the LED lamp panel is received in the holding room; and the lamp holder has a through hole, and the wire passes through the through hole and is connected to the LED lamp panel; and the lamp holder is fixedly connected to the housing and covers and fits the wire slot.

advantageously, the LED lamp further comprising a mounting bracket and a rotating mechanism, and the housing is connected to the mounting bracket through the rotating mechanism, the housing and the LED lamp holder assembly fixed to the housing being able to achieve angled rotation relative to the mounting bracket by the rotating mechanism in a plane perpendicular to the axial direction of the housing.

advantageously, both ends of the lamp holder are provided with a receiving hole for partially receiving the rotating mechanism, so that the lamp holder can be attached and fixed to the housing.

advantageously, the rotating mechanism includes a fixed end cover, an outer end cover and two elastic pressing strips disposed in the outer end cover; The fixed end cover is disposed on two openings of the housing, and middle portion of the fixed end cover is provided with a wire insertion hole, the periphery of the wire insertion hole extends outward along the axial direction of the housing to form a wire barrel, the wire barrel is fixedly provided with a gear, and the gear has strip gear teeth arranged along the axial direction of the gear; the outer end cover is disposed on an outer side of the fixed end cover and fixedly connected to the mounting bracket, the outer end cover has a receiving cavity for receiving the wire barrel and the gear, and the receiving cavity is provided with two mounting grooves, and two ends of the elastic pressing strip are respectively inserted in the mounting groove, and the elastic pressing strip has a limiting rib that clips into the gear, and the gear is rotatable relative to the elastic pressing strip, and is kept in a state of being positioned at an angle direction within the limit of the limiting rib.

advantageously, the elastic pressing strip has an arcuate portion and two mounting portions respectively disposed at both ends of the arcuate portion, and the mounting portion is inserted into the mounting groove; and the arcuate portions of the two elastic pressing strips are oppositely disposed and disposed around the outer edge of the gear, and the limiting ribs are disposed at the arcuate portion is in close contact with the teeth of the gear.

advantageously, the fixed end cover, the wire barrel and the gear are molded into an integral part by injection molding.

advantageously, the lamp holder is in strip shape, and both sides of the lamp holder have slots for inserting the lamp cover in the direction of length.

advantageously, the housing is a semi-cylindrical body formed by a curved plate and a flat plate, and the wire slot is arranged on the flat plate; the housing is an integrally extruded aluminum material.

advantageously, the housing has two openings, and the driving power supply can be loaded from one of the openings; the wire slot is connected one opening of the housing 10 through to another opening of the housing.

Compared with the prior art, advantages of the present invention is that: the LED lamp with built-in power supply of the present invention comprises a housing and LED lamp holder assembly fixed to the outside of the housing, wherein a driving power supply is arranged in the housing. The LED lamp panel is disposed in the accommodating chamber formed by the lamp holder and the lamp cover. The lamp structure sets the driving power supply and LED lamp panel in two isolated cavities respectively, thereby avoiding the LED lamp panel being in the high temperature environment for a long time, and the service life is prolonged; in addition, the housing is provided with a wire slot, which can receive the wire connecting the driving power supply and the LED lamp panel and solve the problems of wire routing difficulty, wire pressure and wire being easily broken in the existing technology. The arrangement of the wire slots fully utilizes the wall thickness of the housing to accommodate the wires therein, which reduces the overall height of the lamp and makes the lamp more compact and more applicable.

BRIEF DESCRIPTION OF THE DRAWINGS

The drawings described herein are intended to promote a further understanding of the present invention, as follows.

DETAILED DESCRIPTION OF THE INVENTION

Embodiments of the invention are described in detail below, Examples of the embodiments are shown in the appended drawings in which consistently identical or similar labels represent identical or similar elements or elements having the same or similar function. The embodiments described below by reference to the drawings are exemplary and are only used for the interpretation of the invention and cannot be understood to be a limitation of the invention.

Figure 1:
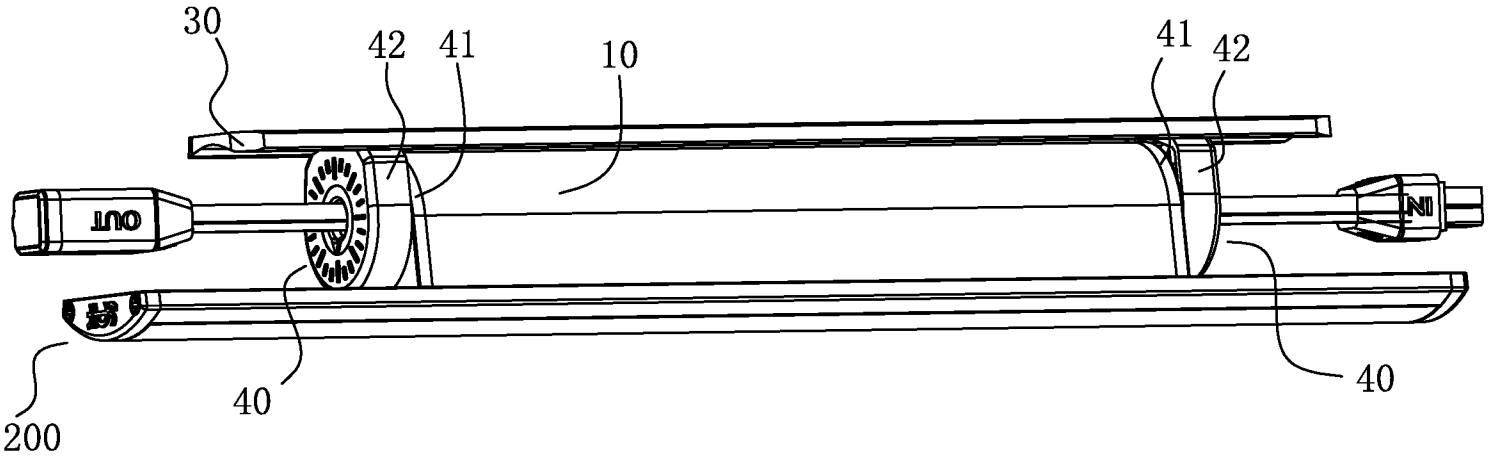
FIG. 1 is a three-dimensional structure diagram of an LED lamp with built-in power supply according to an embodiment of the present invention.
Figure 2:
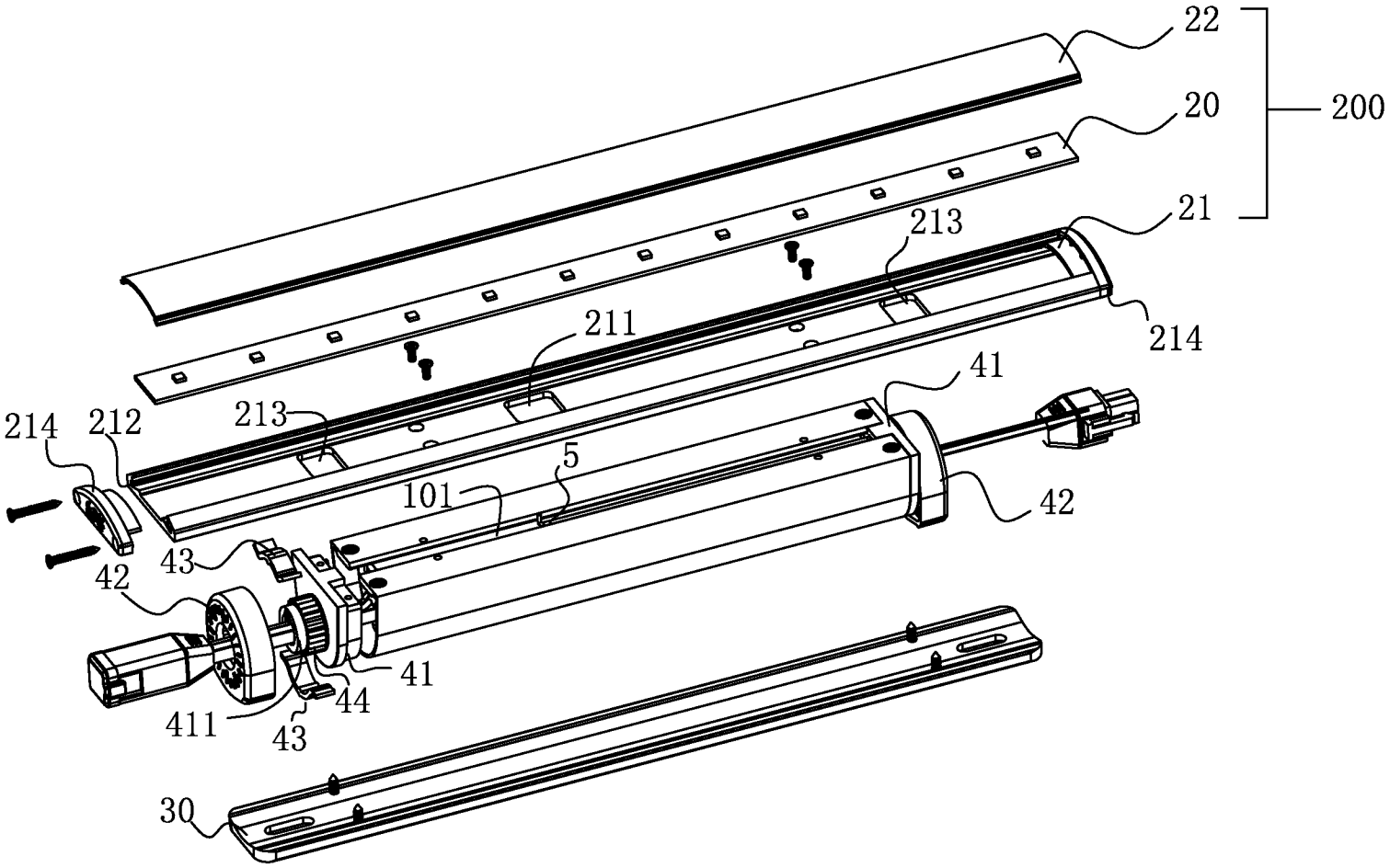
FIG. 2 is an exploded perspective view of an LED lamp with built-in power supply according to an embodiment of the present invention.
Figure 3:
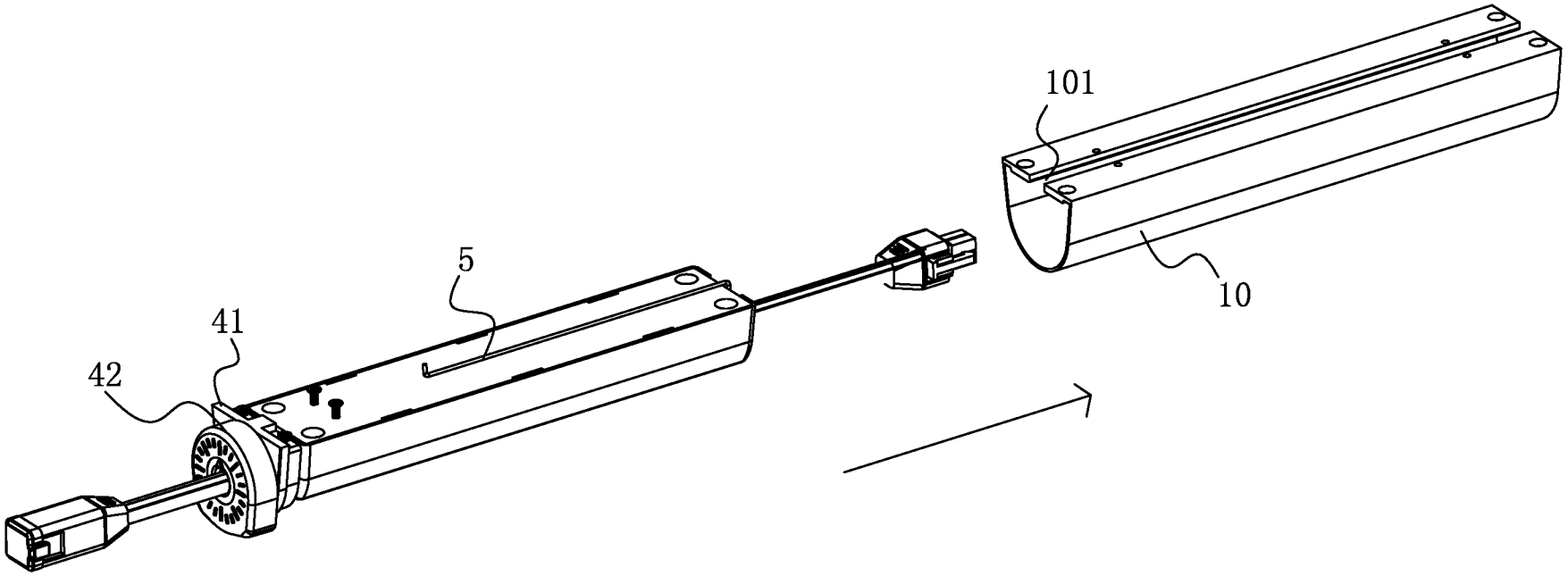
FIG. 3 is a partially exploded perspective view of an LED lamp with built-in power supply according to an embodiment of the present invention, wherein the LED lamp holder assembly is not shown.

As shown in FIG. 1 to FIG. 3, the LED lamp with built-in power supply includes a housing 10, a driving power supply, and an LED lamp holder assembly 200. In this embodiment, the housing 10 and the LED lamp holder assembly 200 are both in strip shape. The housing 10 has two openings, and a driving power supply can be loaded from one of the openings and housed in the housing 10. The outer side of the housing 10 is fixedly connected to the LED lamp holder assembly 200, and the driving power supply and the LED lamp holder assembly 200 are connected through wire 5, and a wire slot 101 is arranged on the housing 10. The wire 5 connected to the driving power supply can be taken out from the wire slot 101 and received in the wire slot 101, and then connected to the LED lamp holder assembly 200. Specifically, the LED lamp holder assembly 200 includes an LED lamp panel 20, a lamp holder 21, and a lamp cover 22, wherein the lamp holder 21 and the lamp cover 22 are fastened to form a holding room, and the LED lamp panel 20 is received in the holding room, and the lamp holder 21 has a through hole 211, and the wire 5 passes through the through hole 211 and is connected to the LED lamp panel 20. Further, the lamp holder 21 is fixedly connected to the housing 10 and can cover and fit the wire slot 101. The lamp structure is configured to dispose the driving power supply and the LED lamp panel 20 in two mutually isolated cavities, thereby avoiding the LED lamp panel 20 being in a high temperature environment for a long time and prolonging the service life thereof; the wire slot 101 is provided, and the wire slot 101 can receive the wire 5 connecting the driving power supply and the LED lamp panel. The arrangement of the wire slot 101 fully utilizes the wall thickness space of the housing 10 to accommodate the wire 5 therein, which reduces the overall height of the lamp, makes the lamp more compact and has a wider range of application, and further solves the problems of wire 5 in the existing technology, such as wire difficulty, wire pressure and wire easy to be broken.

Further, in order to facilitate the installation and illumination angle adjustment of the LED lamp with built-in power supply, the LED lamp further includes mounting bracket 30 and rotating mechanism 40, wherein the mounting bracket 30 is used for fixing the main body of the lamp to the cabinet or the booth or the other mounting position to be installed, after the main body of the lamp is fixedly mounted, the appropriate illumination angle can be adjusted by the rotating mechanism 40 of the lamp. It should be noted that the rotating mechanism 40 can be two, respectively disposed at two ends of the housing 10, and the rotating mechanism 40 can also be one, which is arranged at one end of the housing 10, and the other end of the corresponding housing 10 is provided with a conventional rotating shaft to perform rotation adjustment in cooperation with the rotating mechanism 40. In this embodiment, the two ends of the housing 10 of the LED lamp with built-in power supply are provided with a rotating mechanism 40 and connected to the mounting bracket 30 through the rotating mechanism 40, the housing 10 and the LED lamp holder assembly 200 fixed on the housing 10 can be rotated in a plane perpendicular to the axial direction of the housing 10 through the rotating mechanism 40 relative to the mounting bracket 30, wherein the two ends of the lamp holder 21 are provided with a receiving hole 213 for partially receiving the rotating mechanism 40, so that the lamp holder 21 can be attached and fixed to the housing 10. The fitting arrangement of the lamp holder 21 and the housing 10 further reduces the overall height of the lamp, takes up less space, and can be conveniently installed into a narrow booth or cabinet.

In this embodiment, the rotating mechanism 40 includes a fixed end cover 41, an outer end cover 42 and two elastic pressing strips 43 disposed in the outer end cover 42; the fixed end cover 41 is disposed on the two openings of the housing 10, the middle part of the fixed end cover 41 is provided with a wire insertion hole, wherein the wire insertion hole is convenient for passing through the electric wire of external circuit to connect the driving power in the housing 10. Further, the periphery of the wire insertion hole extends outward along the axial direction of the housing 10 to form a wire barrel 411, the wire barrel 411 is fixedly provided with a gear 44 and the gear 44 has strip gear teeth arranged along the axial direction of the gear 44, wherein the gear 44 can be a split piece that is fixedly connected to the wire barrel 411 and can be rotated together with the wire barrel 411, or an integral piece formed by injection molding or the like with the wire barrel 411. In the present embodiment, the fixed end cover 41, the wire barrel 411, and the gear 44 are molded into an integral part by injection molding. This one-piece mechanism reduces the number of parts of the LED lamp, which is convenient for installation.

Figure 4:
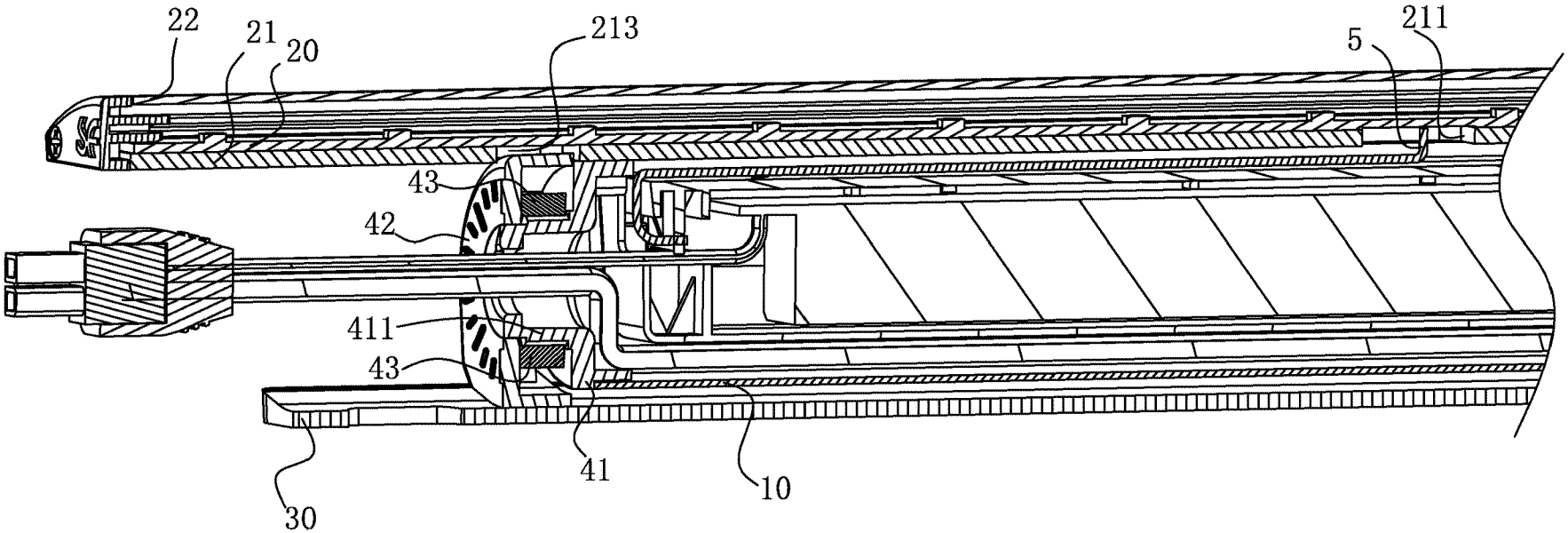
FIG. 4 is a cross-sectional view of an LED lamp with built-in power supply in accordance with an embodiment of the present invention.
Figure 5:
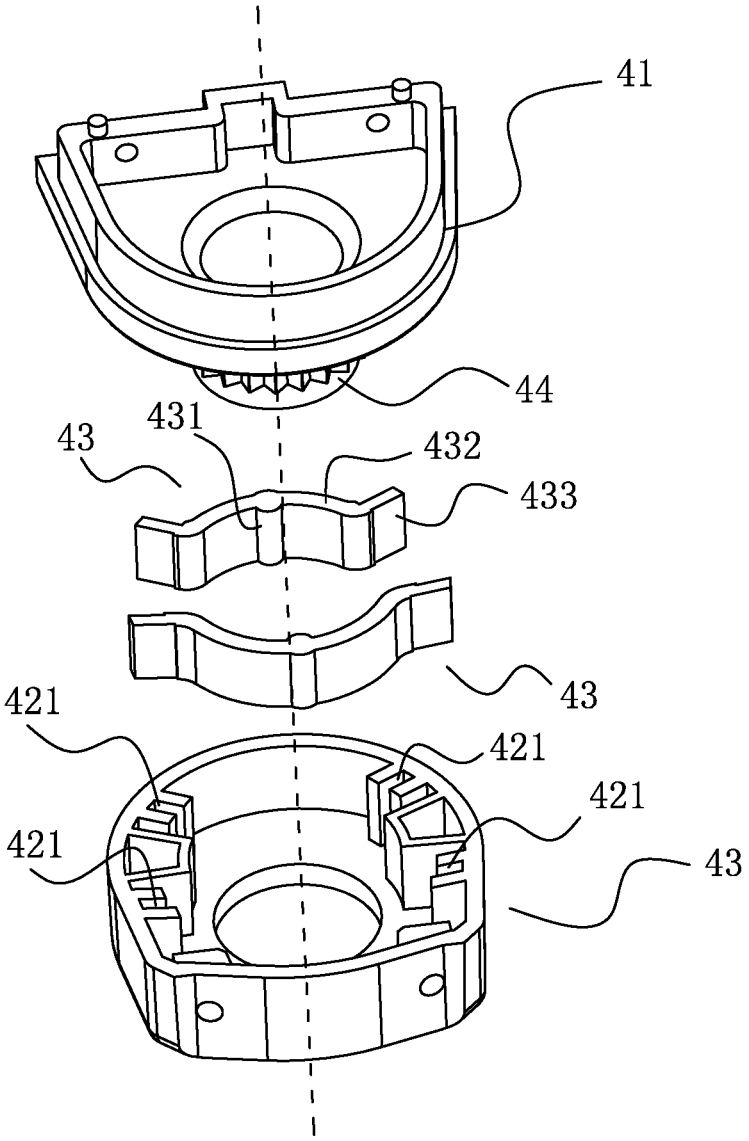
FIG. 5 is an exploded perspective view showing a rotating mechanism of an LED lamp with built-in power supply according to an embodiment of the present invention.

More specifically, referring to FIG. 4 and FIG. 5, the outer end cover 42 is disposed on the outer side of the fixed end cover and fixedly connected to the mounting bracket 30. Specifically, the outer end cover 42 and the mounting bracket 30 are fixedly connected by screws. The outer end cover 42 has a receiving cavity for receiving the wire barrel 411 and the gear 44. The receiving cavity is provided with two mounting grooves 421, and two ends of the elastic pressing strip 43 are respectively inserted in the mounting groove 421, and the elastic pressing strip 43 has the limiting rib 431 that clip into the gear 44, and the gear 44 rotates relative to the elastic pressing strip 43 and remains positioned at an angular direction within the limit of the limiting rib 431.

More specifically, the elastic pressing strip 43 has an arcuate portion 432 and two mounting portions 433 respectively disposed at both ends of the arcuate portion 432. The mounting portion 433 is inserted into the mounting groove 421, and the arcuate portions 432 of the two elastic pressing strips 43 are oppositely disposed and disposed around the outer edge of the gear 44, the limiting rib 431 is disposed on the arcuate portion 432 and is in tight fit with the teeth of the gear 44. The elastic pressing strip 43 can be made of elastic material such as plastic or metal. The elastic pressing strip 43 has an elastic deformation. When the gear 44 is ready to rotate, the force of limiting rib 431 tends to be far away from the gear teeth of the gear 44 to facilitate the rotation of gear 44 relative to the outer end cover 42. When any one of the gear units (ie, one tooth) is rotated, the elastic pressing strip 43 can be reset again, so that the limiting rib 431 is engaged on the gear 44 and are closely matched with the teeth of the gear 44, and the limiting action can keep the main body of the lamp in a state of being oriented at an angle after rotating a certain angle.

See FIG. 2 and FIG. 4 again, the lamp holder 21 is in strip shape, and the two sides of the lamp holder 21 have slots 212 for inserting the lamp cover 22 in the direction of length, Two sealing covers 214 for sealing the slots at both ends of the slot 212 are also provided at both ends of the lamp holder 21. The housing 10 is a semi-cylindrical body formed by a curved plate and a flat plate, and the wire slot 101 is arranged on the flat plate. The lamp holder 21 is fixedly connected to the flat plate and covered to the wire slot 101. In this embodiment, the wire slot 101 is connected through one opening of the housing 10 to another opening of the housing 10. Specifically, the housing 10 is an integrally extruded aluminum material, that is, the curved plate and flat plate of the housing 10 are formed as a whole, and the heat dissipation effect of the aluminum profile housing 10 is better.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. An LED lamp with a built-in power supply, characterized in that: comprising:

a housing with a driving power supply built-in;

an LED lamp holder assembly fixedly connected to an outer side of the housing and connected to the driving power supply via a wire for receiving electrical power from the power supply;

a wire slot is arranged on the housing, the wire connected to the driving power supply can be taken out from the wire slot and received in the wire slot and then connected to the LED lamp holder assembly;

a mounting bracket; and a rotating mechanism, wherein the LED lamp holder assembly further includes an LED lamp panel, a lamp holder and a lamp cover, the lamp holder and the lamp cover are fastened to form a holding room, and the LED lamp panel is received in the holding room, the lamp holder has a through hole, and the wire passes through the through hole and is connected to the LED lamp panel, the lamp holder is fixedly connected to the housing and covers and fits the wire slot, and the housing is connected to the mounting bracket through the rotating mechanism, the housing and the LED lamp holder assembly fixed to the housing being able to achieve angled rotation relative to the mounting bracket by the rotating mechanism in a plane perpendicular to an axial direction of the housing.

2. The LED lamp with built-in power supply of claim 1, wherein both ends of the lamp holder are provided with a receiving hole for partially receiving the rotating mechanism, so that the lamp holder can be attached and fixed to the housing.

3. The LED lamp with built-in power supply of claim 2, wherein the rotating mechanism includes a fixed end cover, an outer end cover and two elastic pressing strips disposed in the outer end cover;

the fixed end cover is disposed on two openings of the housing, and middle portion of the fixed end cover is provided with a wire insertion hole, the periphery of the wire insertion hole extends outward along the axial direction of the housing to form a wire barrel, the wire barrel is fixedly provided with a gear, and the gear has strip gear teeth arranged along the axial direction of the gear;

the outer end cover is disposed on an outer side of the fixed end cover and fixedly connected to the mounting bracket, the outer end cover has a receiving cavity for receiving the wire barrel and the gear, and the receiving cavity is provided with two mounting grooves, and two ends of the elastic pressing strip are respectively inserted in the mounting groove, and the elastic pressing strip has a limiting rib that clips into the gear, and the gear is rotatable relative to the elastic pressing strip, and is kept in a state of being positioned at an angle direction within the limit of the limiting rib.

4. The LED lamp with built-in power supply of claim 3, wherein the elastic pressing strip has an arcuate portion and two mounting portions respectively disposed at both ends of the arcuate portion, and the mounting portion is inserted into the mounting groove;

and the arcuate portions of the two elastic pressing strips are oppositely disposed and disposed around the outer edge of the gear, and the limiting ribs are disposed at the arcuate portion in contact with the teeth of the gear.

5. The LED lamp with built-in power supply of claim 4, wherein the fixed end cover, the wire barrel and the gear are molded into an integral part by injection molding.

6. The LED lamp with built-in power supply of claim 1, wherein the lamp holder is in strip shape, and both sides of the lamp holder have slots for inserting the lamp cover in the lengthwise direction.

7. The LED lamp with built-in power supply of claim 6, wherein the housing is a semi-cylindrical body formed by a curved plate and a flat plate, and the wire slot is arranged on the flat plate; the housing is an integrally extruded aluminum material.

8. The LED lamp with built-in power supply of claim 7, wherein the housing has two openings, and the driving power supply can be loaded from one of the openings; the wire slot is connected by one opening of the housing through to another opening of the housing.

* * * * *